US009598893B2

(12) United States Patent
Vandervelden et al.

(10) Patent No.: US 9,598,893 B2
(45) Date of Patent: Mar. 21, 2017

(54) LEAF PROFILE FOR A WINDOW, A WINDOW AND METHOD FOR INSTALLING A WINDOW

(71) Applicant: REYNAERS ALUMINUM, NAAMLOZE VENNOOTSCHAP, Duffel (BE)

(72) Inventors: Stefan Vandervelden, Berchem (BE); Veronique Vloemans, Oelegem (BE)

(73) Assignee: REYNAERS ALUMINIUM, NAAMLOZE VENNOOTSCHAP, Duffel (BE)

( * ) Notice: Subject to any disclaimer, the term of this patent is extended or adjusted under 35 U.S.C. 154(b) by 0 days.

(21) Appl. No.: 14/395,215

(22) PCT Filed: Apr. 16, 2013

(86) PCT No.: PCT/BE2013/000018
§ 371 (c)(1),
(2) Date: Oct. 17, 2014

(87) PCT Pub. No.: WO2013/155573
PCT Pub. Date: Oct. 24, 2013

(65) Prior Publication Data

US 2015/0128521 A1 May 14, 2015

(30) Foreign Application Priority Data

Apr. 20, 2012 (BE) ..... 2012/0260

(51) Int. Cl.
*E06B 3/30* (2006.01)
*E06B 1/34* (2006.01)
(Continued)

(52) U.S. Cl.
CPC ..... *E06B 1/342* (2013.01); *E04F 19/02* (2013.01); *E04F 19/06* (2013.01); *E06B 1/36* (2013.01); *E06B 3/5409* (2013.01); *E06B 3/6621* (2013.01)

(58) Field of Classification Search
CPC ..... E06B 1/342; E06B 3/5409; E06B 3/6621
(Continued)

(56) References Cited

U.S. PATENT DOCUMENTS 3,148,753 A * 9/1964 Hodgen ..... E06B 3/44 52/204.51
4,811,532 A * 3/1989 Fratti et al. ..... E06B 1/325 52/172
(Continued)

FOREIGN PATENT DOCUMENTS

DE 3 217 244 A1 11/1983
EP 0 524 631 A1 1/1993
EP 0 638 702 A2 2/1995

OTHER PUBLICATIONS

International Search Report, dated Oct. 10, 2013, from corresponding PCT application.

*Primary Examiner* — Adriana Figueroa
(74) *Attorney, Agent, or Firm* — Young & Thompson

(57) ABSTRACT

Covering element (7) to cover the edge of a glass pane (5), characterized in that the covering element (7) includes a leaf profile (6) for a leaf (3,4) of a window (1) or door and includes at least one adjustable setting piece (10), whereby the setting piece (10) is or can be fastened to an edge of the glass pane (5), whereby the leaf profile (6) is or can be connected to the setting piece (10), and whereby the setting piece (10) is arranged to be able to adjust the distance between the leaf profile (6) and the edge of the glass pane (5) when using the covering element (7).

17 Claims, 5 Drawing Sheets

(51) Int. Cl.

| | |
|---|---|
| ***E06B 3/54*** | (2006.01) |
| ***E04F 19/02*** | (2006.01) |
| ***E04F 19/06*** | (2006.01) |
| ***E06B 1/36*** | (2006.01) |
| *E06B 3/66* | (2006.01) |

(58) Field of Classification Search
USPC ..... 52/204.6, 204.62, 204.69, 204.7, 204.59, 52/656.5, 1
See application file for complete search history.

(56) References Cited

U.S. PATENT DOCUMENTS

| | | | | | |
|---|---|---|---|---|---|
| 4,920,717 | A * | 5/1990 | Hooper, Jr. | E04F 11/1851 | 256/24 |
| 4,958,468 | A * | 9/1990 | Nolan | E06B 3/222 | 49/DIG. 2 |
| 5,560,149 | A * | 10/1996 | Lafevre | E06B 3/44 | 49/404 |
| 5,768,836 | A * | 6/1998 | Bachmann | E06B 1/325 | 49/504 |
| 6,434,905 | B1 * | 8/2002 | Sprague | E06B 3/02 | 49/501 |
| 7,707,779 | B2 * | 5/2010 | Petta | E06B 3/44 | 49/125 |
| 7,963,077 | B2 * | 6/2011 | Lin | E06B 3/72 | 52/204.591 |
| 2006/0070318 | A1 * | 4/2006 | Chen | E06B 3/5454 | 52/204.65 |

* cited by examiner

LEAF PROFILE FOR A WINDOW, A WINDOW AND METHOD FOR INSTALLING A WINDOW

BACKGROUND OF THE INVENTION

Field of the Invention

The present invention relates to a leaf profile for a window, a window and a method for installing a window.

More specifically, the invention concerns windows whereby a leaf of a window has a leaf profile along all or part of its edges that is fastened to the edge of a glass pane, for example by gluing.

Description of the Related Art

This can for example, but not exclusively, be 'minimum profile windows' in which the leaves are manufactured from very thin profiles that are essentially hidden from view because they are behind an outer frame placed in the wall. These leaf profiles are normally glued to the edge of the glass pane that also forms part of the leaf.

However, a problem arises here relating to the accommodation of tolerances. An outer frame of a window is made to a certain size, and then installed in a wall. The glass pane or the glass panes of a window is or are made to a certain size beforehand.

In practice both the frame and the glass panes may deviate from a specified target size by a few millimeters or more due to their production. There can also be differences relating to the formation of a perfect rectangle.

With non-glued leaf profiles, the differences are traditionally accommodated by pinning the glass in the leaves. However, this is not possible when the leaf profile and the glass are glued, and thus when the leaf profile is supported by the glass pane instead of the other way around as with conventional leaves.

BRIEF SUMMARY OF THE INVENTION

The purpose of the present invention is to provide a solution to a least one of the aforementioned and other disadvantages by providing a covering element to cover the edge of a glass pane, whereby the covering element comprises a leaf profile of a leaf of a window or door and comprises at least one adjustable setting piece, whereby the setting piece is or can be fastened to an edge of the glass pane, whereby the leaf profile is or can be connected to the setting piece, and whereby the setting piece is arranged to be able to adjust the distance between the leaf profile and the edge of the glass pane when using the covering element.

As specified above, it concerns a leaf profile that is supported by a glass pane, that thus does not form part of a frame that supports and surrounds the glass pane.

In other words, the leaf profile is freely adjustable with respect to the glass pane without restrictions that are caused by it being fastened to other leaf profiles that are fastened to the glass pane.

In this way the setting piece can be fastened to the glass pane while the positioning of the leaf profile with respect to the setting piece can be adjusted for the purpose of compensating for the manufacturing tolerances of the glass pane and a frame of the window.

To this end preferably a few setting pieces are provided along each edge of the glass pane along which a leaf profile has to be affixed, so that an accurate adjustment can be obtained.

Preferably the setting piece comprises a first part that is arranged to be mounted on the glass pane and a second part that is arranged to keep the leaf profile at a set minimum distance from the first part, whereby preferably the second part is adjustably fastened by means of a screw thread in the first part.

This is a practical embodiment of the setting piece.

In a preferred embodiment the leaf profile can be fastened to the first part of the setting piece and not, or only indirectly, to the second part of the setting piece.

In this way a good direct connection between the glass pane and the leaf profile is created that cannot vary over time due to variations of the setting of the setting piece.

In a further preferred embodiment the covering element also comprises a connecting profile that is intended to be fastened to an edge of a glass pane, whereby the connecting profile and the setting piece are arranged such that the setting piece is or can be fastened to an edge of the glass pane by means of the connecting profile.

In a further preferred embodiment the leaf profile is provided with an opening along which the second part of the setting piece can be driven.

As a result the setting piece can be driven more easily.

In a further preferred embodiment the first part of the setting piece is provided with two folded-over protruding ridges extending on either side that each define an L-shaped groove, and is provided with a first, second and third screw hole that is perpendicular to the direction in which the grooves extend, whereby the second part of the setting piece is a bolt or screw that fits in the second screw hole that is provided with a driving recess on the side turned away from the grooves.

This is a practical embodiment to manufacture such a setting piece.

The driving recess is a recess that is intended to enable the screw or bolt to be turned by means of a complementary tool, for example a straight slot, cross slot, socket or star.

The setting piece can be made from various different materials, whereby metal and high quality plastic are the most obvious.

The invention also relates to a setting piece for use in a covering element as described above and a window that comprises a glass pane and a covering element as described above, whereby the setting piece is fastened to the edge of the glass pane by means of the connecting profile if present.

Furthermore the invention concerns a method for installing a window that comprises an outer frame and at least one glass pane, whereby a leaf profile is affixed at an edge of the glass pane, whereby an adjustable setting piece is fastened directly or indirectly to the glass pane, whereby the leaf profile is fastened to the glass pane by means of the setting piece, whereby the distance between the edge of the glass pane and the leaf profile is adjusted by means of the setting piece.

The invention also concerns the use of an adjustable setting piece that is fastened to a glass pane in order to mount a leaf profile at a specific distance from an edge of the glass pane.

BRIEF DESCRIPTION OF THE DRAWINGS

With the intention of better showing the characteristics of the invention, a preferred embodiment of a window with a leaf profile according to the invention is described hereinafter by way of an example, without any limiting nature, with reference to the accompanying drawings, wherein.

DETAILED DESCRIPTION OF THE PREFERRED EMBODIMENTS

Figure 1:
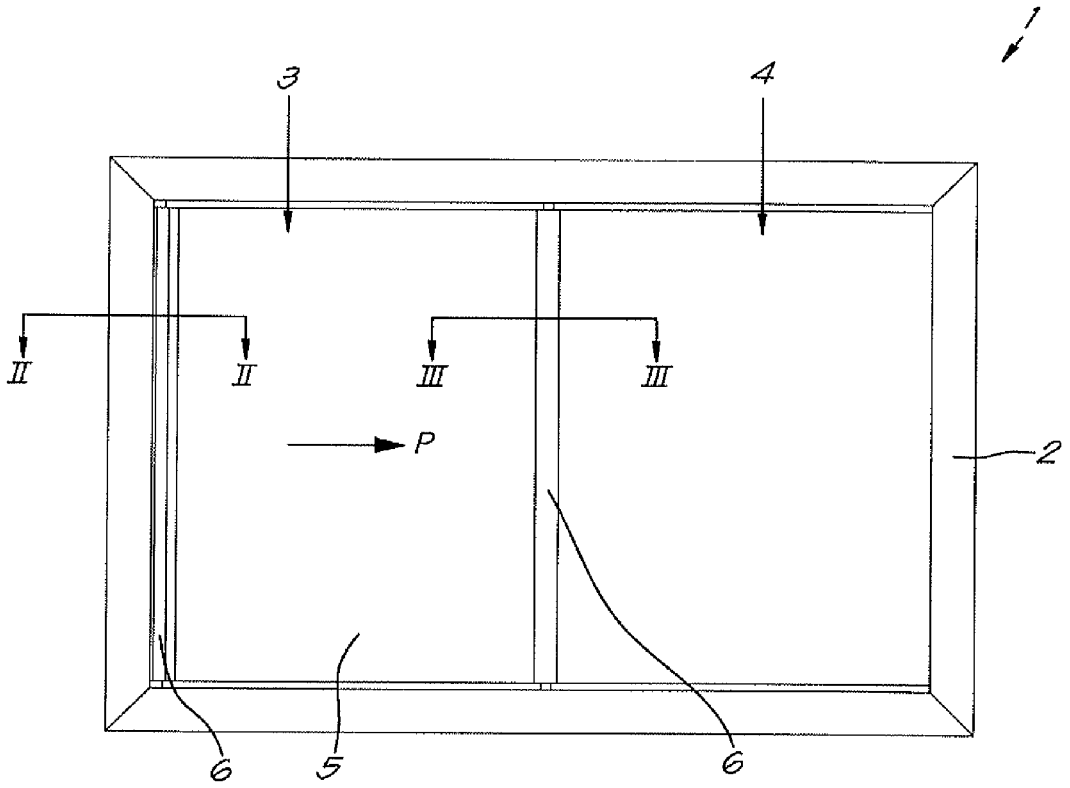
FIG. 1 schematically shows a window according to the invention.
Figure 2:
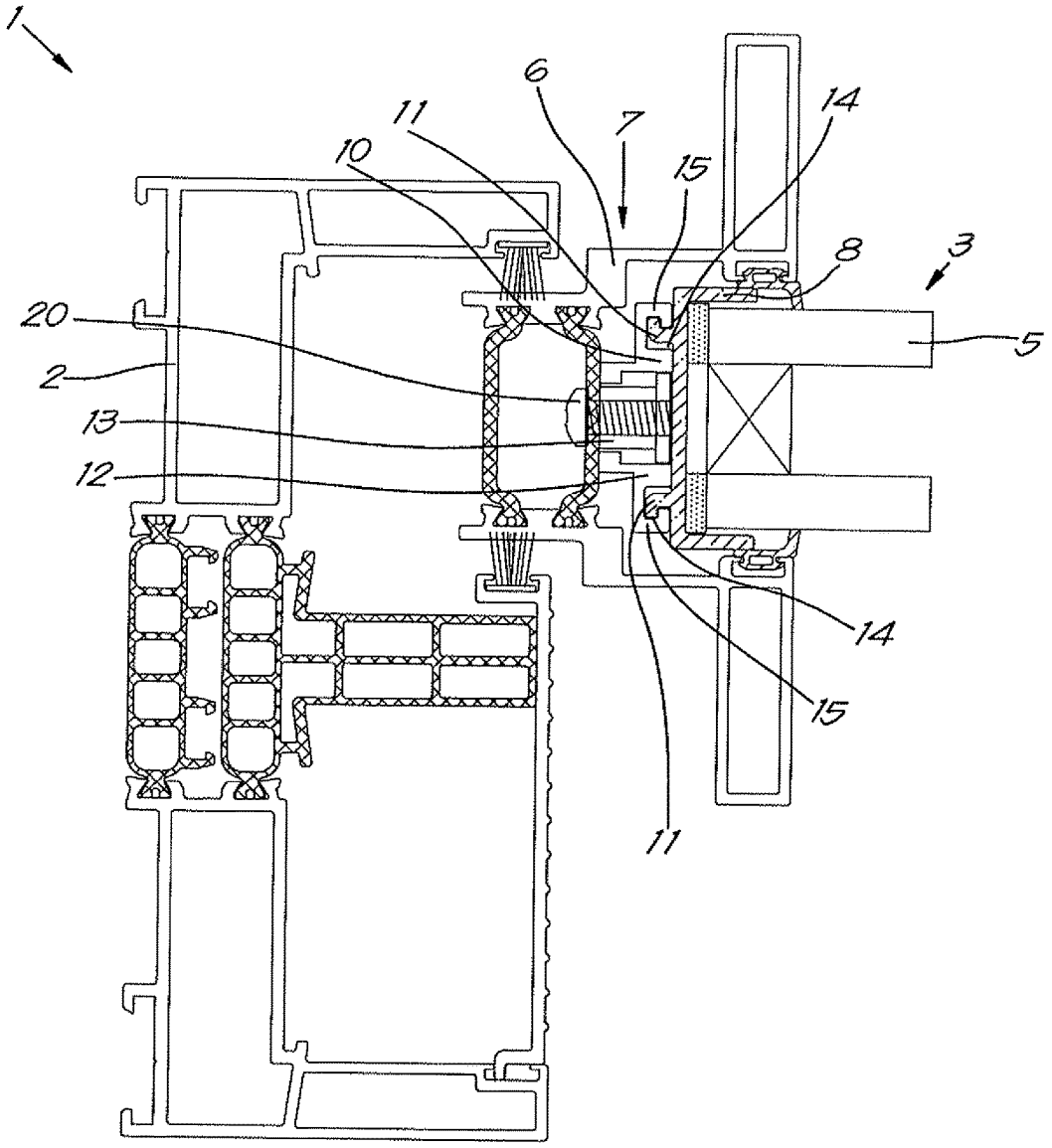
FIG. 2 shows a cross-section according to line II-II through the window of FIG. 1.
Figure 3:
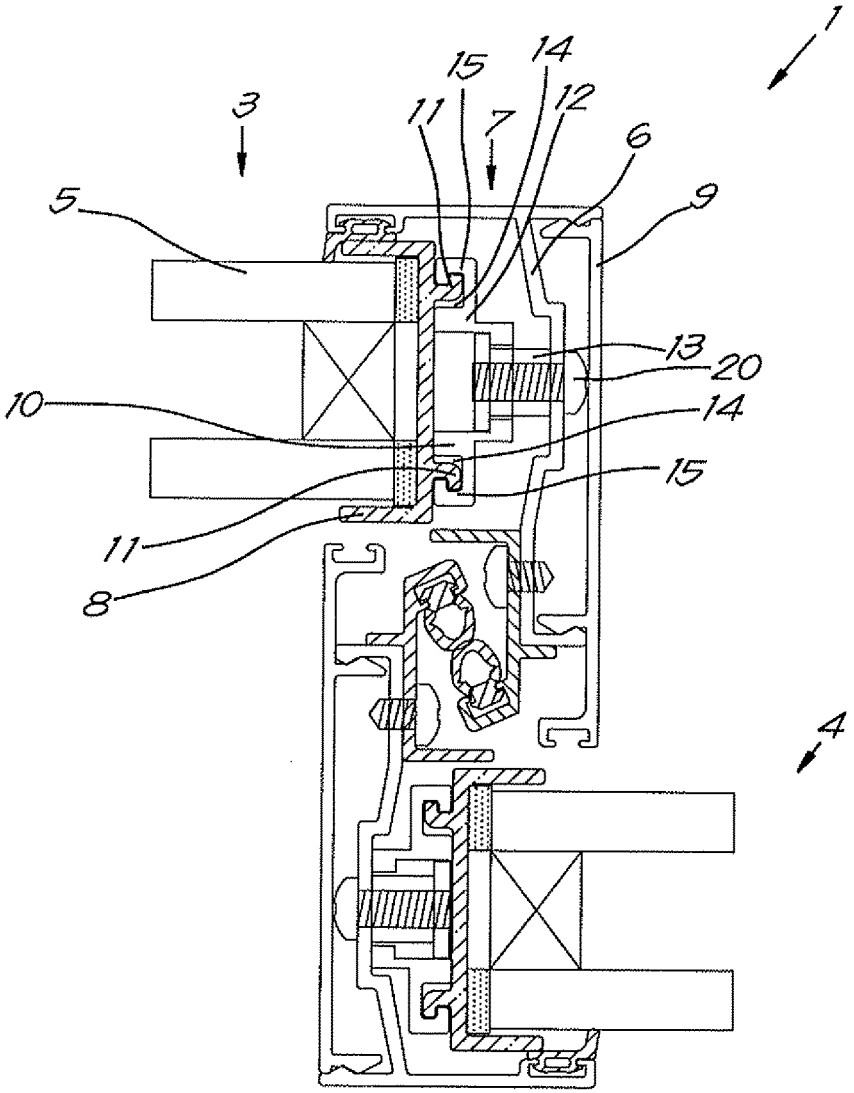
FIG. 3 shows a cross-section according to line III-III through the window of FIG. 1.

The window 1 shown in FIGS. 1 to 3 is a sliding window and essentially consists of a frame 2 and two leaves 3 and 4 affixed in the frame 2, more specifically a slidable leaf that can be slid in the direction of the arrow P and a non-slidable leaf 4.

The leaves 3,4 essentially consist of a glass pane 5 that is provided on one or more of its edges with a leaf profile 6. The leaf profile 6 forms part of a covering element 7 that further comprises a connecting profile 8 and a covering profile 9 that are practically parallel to one another. The covering element also comprises a number of setting pieces 10, for example three of four.

The covering profile 9 is snapped onto the leaf profile 6 by means of a snap connection. On the side of the connecting profile 8 turned away from the glass pane 5 there are two L-shaped teeth 11 in the longitudinal direction of the connecting profile 8.

The connecting profile 8 fits over an edge of the glass pane 5 and is glued to it. The connecting profile 8 and the leaf profile 6 are fastened together by means of the setting pieces 10, that are affixed spread over the length of the edge concerned of the glass pane 5.

Figure 4:
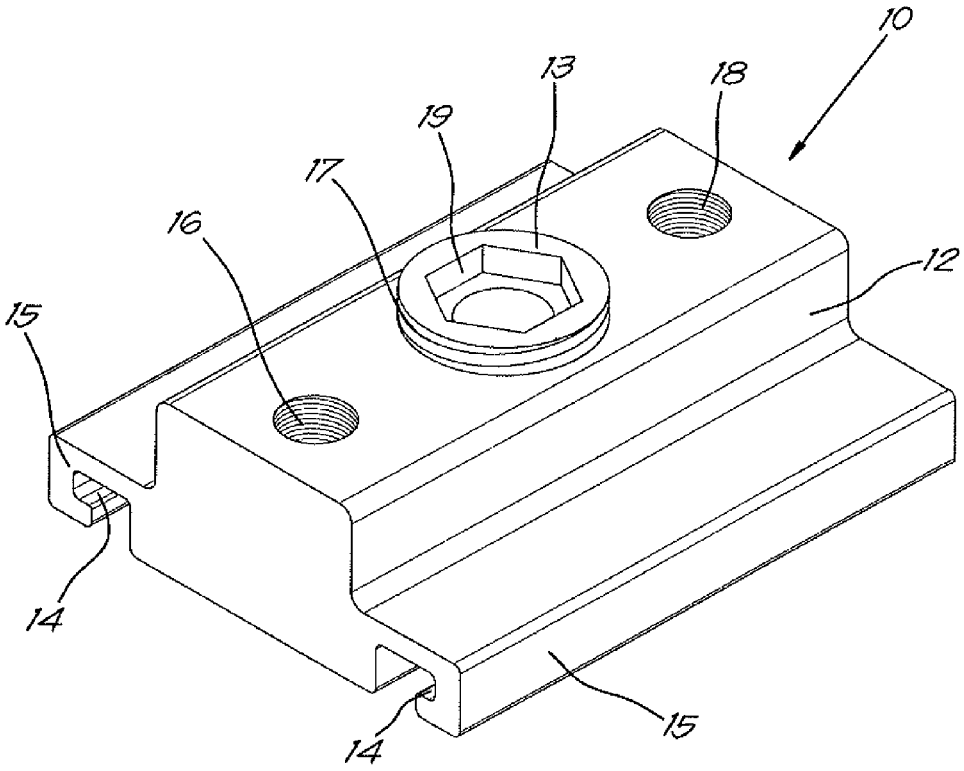
FIGS. 4 and 5 show a component of a window according to FIG. 1 in detail in two different views.
Figure 5:
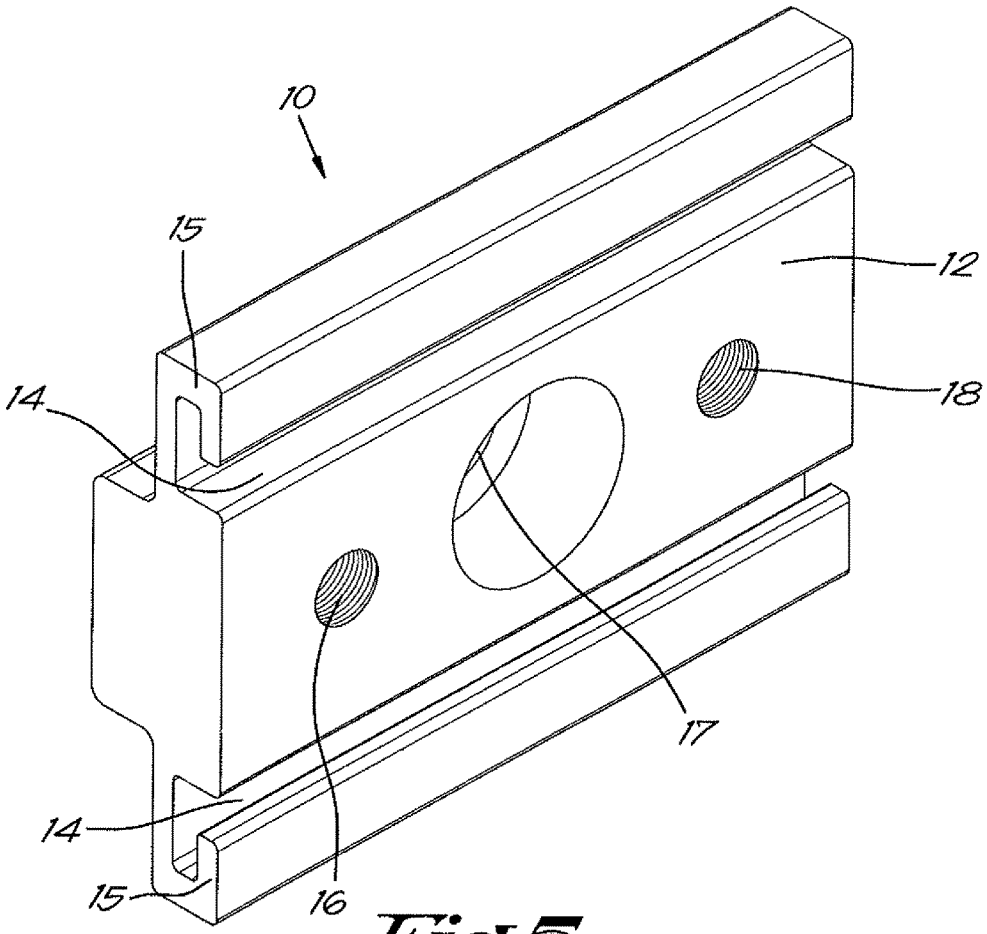

A separate setting piece 10 is shown in FIGS. 4 and 5. This consists of a first part 12 and a second part 13.

In this example, but not necessarily, the first part 12 is an aluminium body that is provided with two parallel grooves 14, with a form that is complementary to the teeth 11, and which is formed by folded-over ridges 15 on the body. The first part 12 is provided with three holes with a screw thread that go completely through the first part 12, i.e. a first screw hole 16, a second screw hole 17 and a third screw hole 18.

The second part 13 of the setting piece 10 is formed by a bolt with a socket 19.

The setting pieces 10 are mounted on the connecting profile 8 by placing the teeth 11 in the grooves 14, and by affixing a pressure screw (not shown) in the first screw hole 16. This pressure screw is turned such that it pushes against the connecting profile 8, and thereby secures the teeth 11 in the grooves 14.

The leaf profile 8 is mounted on the setting pieces 11 by means of a bolt 20 that fits in the third screw hole 18 that is turned until the leaf profile 6 rests against the second part 13 of the setting pieces 10.

In order to gain access to the socket 19 of the second part 13, the leaf profile 8 is provided with holes at the places where the second part 13 of the setting pieces 10 are located.

The use of the covering element according to the invention during the assembly of the window 1 is as follows.

At the places where leaf profiles 6 are desired, connecting profiles 8 are glued over the edge of the glass panes 5. The setting pieces 10 and the leaf profiles 6 are then affixed.

The covering elements 7 can also be affixed in a pre-assembled state over the edge of the glass panes 5.

The frame 2 and the wings 3,4 are fitted in the traditional way. The covering elements are then adjusted by loosening the bolts 20, via the holes provided in the leaf profile 6, and turning the second parts 13 of the setting pieces 10 further in or out of the first parts 12 of the setting pieces 10, and when the adjustment is as desired, the bolts 20 are tightened again. Then the covering profile 9 is snapped in its place in order to conceal the holes for accessing the sockets 19 and the bolts 20 from view.

Figure 6:
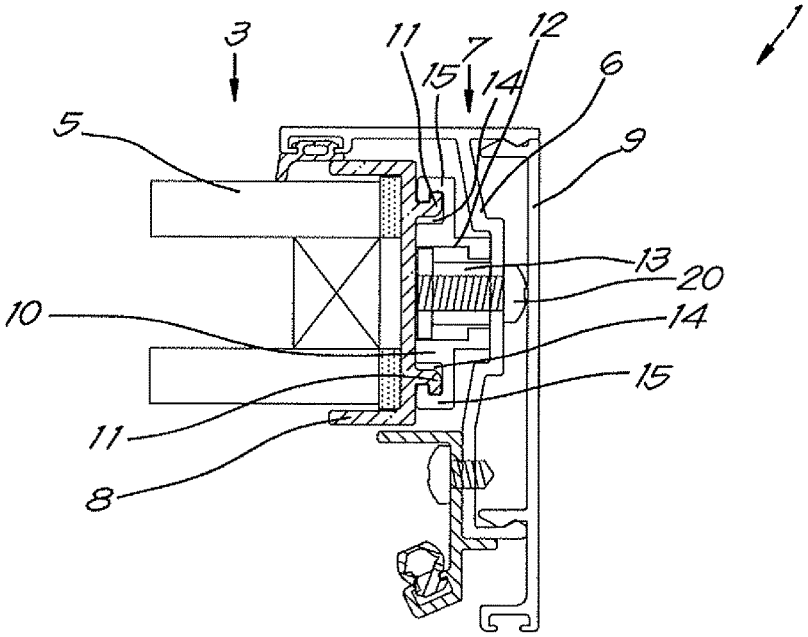
FIG. 6 shows a part of the cross-section of FIG. 3 in an alternative usage state.

FIG. 6 shows a situation in which the leaf profile 6 is fastened as closely as possible to the glass pane 5, which means that the second part 13 of the setting piece 10 is screwed into the first part 12 to a maximum.

The opposite situation is shown in FIG. 3. All intermediate situations, thus intermediate distances between the leaf profile 6 and the glass pane 5 are also possible.

As part of the function of the covering element 7 consists of compensating for manufacturing differences, not all setting pieces 10 have the same position at an edge of a leaf 3, 4.

During adjustment the following considerations are made: in the closed position of the window 2 this window 2 must be properly closable. The visible parts of the leaf profiles 6 must also run parallel to the sides of the frame 2 and one another.

Preferably the leaf profiles 6 also have to be precisely behind one another at the places where two leaves 3,4 connect together, in a view perpendicular to the glass panes 5, so that the complete leaf profiles 6 appear narrower.

Although in the above example the setting pieces are fastened to the glass pane via a connecting profile, it is also possible within the scope of the invention to fasten the setting pieces to a glass pane in another way, such as for example by directly gluing the setting pieces to the glass pane, or by a clamping mechanism that forms part of or is connected to the setting pieces.

Although a setting piece with a first part and one, centrally placed, second part is described above, the setting piece can also be constructed with a second part that is not on the central axis, thus not in line with the first and third screw hole.

The setting piece can also be constructed with two or more second parts that do not necessarily have to be on the central axis.

This has the advantage that the leaf profile can be somewhat rotated locally or entirely around an axis, defined by the edge of the glass pane, before being secured. In this way any mutual differences in the size of the glass plates, which together form a multilayered glass pane, are compensated for.

The present invention is by no means limited to the embodiment described as an example and shown in the drawings, but a covering element, setting piece and window according to the invention can be realised in all kinds of variants, without departing from the scope of the invention.

The invention claimed is:

1. A covering element to cover an edge of a glass pane, the covering element comprising:

a leaf profile for a leaf of a window or a door;

at least one adjustable setting piece configured to be fastened to the edge of the glass pane, the leaf profile being configured to be connected to the setting piece, the setting piece being configured, in a connected state of the covering element to the edge of the glass pane, to allow adjustment of the distance between the leaf profile and the edge of the glass pane, the setting piece comprising a first part configured to be fastened to the glass pane, and a second part configured to maintain the leaf profile at a set minimum distance from the first part; and a connecting profile configured to be fastened to the edge of the glass pane, wherein the connecting profile and the setting piece are configured such that the setting piece is fastenable to the edge of the glass pane by the connecting profile, and wherein the leaf profile is fastened to the first part of the setting piece and is not configured to be directly fastened to the second part of the setting piece.

2. The covering element according to claim 1, wherein the leaf profile does not form part of a frame that supports and surrounds the glass pane.

3. A window comprising:

a glass pane; and the covering element according to claim 1, wherein the setting piece is fastened to the edge of the glass pane by the connecting profile.

4. The covering element according to claim 1, wherein the setting piece is configured to be fastened to the edge of the glass pane independently of the leaf profile.

5. The covering element according to claim 1, wherein the second part is provided with an external screw thread, and the first part is provided with a complementary internal screw thread.

6. The covering element according to claim 1, wherein the second part is configured to be adjustably fastened by a screw thread in the first part.

7. The covering element according to claim 1, wherein the connecting profile is provided with teeth with a widened head, and the first part of the setting piece is provided with undercut grooves complementary to the teeth, the first part of the setting piece being configured to be mounted on the connecting profile by joining the grooves and the teeth.

8. The covering element according to claim 7, wherein the setting piece is connectable to the connecting profile by a pressure screw that pushes against the connecting profile and thereby fastens the setting piece against the head of the teeth.

9. The covering element according to claim 1, wherein the leaf profile is provided with an opening by which the second part of the setting piece is configured to be adjusted.

10. The covering element according to claim 9, further comprising a covering profile configured to cover the opening.

11. The covering element according to claim 1, wherein the first part of the setting piece is provided with two bent protruding ridges extending on either side of the first part that each define an L-shaped groove, the first part of the setting piece being provided with a first screw hole, a second screw hole, and a third screw hole that are perpendicular to the direction in which the grooves extend, the second part of the setting piece being a bolt or screw that fits in the second screw hole that is provided with a driving recess on the side turned away from the grooves.

12. A setting piece for use in the covering element according to claim 1.

13. The window according to claim 3, wherein the covering element comprises a connecting profile that is fastened to the edge of the glass pane and glued thereto.

14. The covering element according to claim 2, wherein the second part is provided with an external screw thread, and the first part is provided with a complementary internal screw thread.

15. The covering element according to claim 1, wherein the connecting profile is configured to be fastened to the edge of the glass pane independently of the setting piece.

16. The covering element according to claim 1, wherein the leaf profile and the setting piece are detachably connected to one another.

17. The covering element according to claim 1, wherein the connecting profile is configured to be fastened to the edge of the glass pane independently of the setting piece, and the leaf profile and the setting piece are detachably connected to one another.

* * * * *